United States Patent [19]

Fargo

[11] Patent Number: 5,014,824

[45] Date of Patent: May 14, 1991

[54] HYDRAULIC ELEVATOR CONTROL VALVE

[75] Inventor: Richard N. Fargo, Plainville, Conn.

[73] Assignee: Otis Elevator Company, Farmington, Conn.

[21] Appl. No.: 467,445

[22] Filed: Jan. 19, 1990

[51] Int. Cl.[5] ..... B66B 11/04

[52] U.S. Cl. ..... 187/17; 187/29.2; 91/454

[58] Field of Search ..... 187/17, 28, 29.2, 110; 91/451, 454, 443, 445; 60/452, 477; 137/505.13, 495

[56] References Cited

U.S. PATENT DOCUMENTS

| | | | |
|---|---|---|---|
| 2,563,295 | 8/1951 | Westbury | 91/454 |
| 4,557,180 | 12/1955 | Glomeau | 91/454 |
| 4,676,140 | 6/1987 | Haussler | 187/17 |

FOREIGN PATENT DOCUMENTS

| | | | |
|---|---|---|---|
| 0227296 | 7/1987 | European Pat. Off. | 187/17 |
| 3836212 | 5/1989 | Fed. Rep. of Germany | 187/17 |

*Primary Examiner*—Robert P. Olszewski
*Assistant Examiner*—Kenneth Noland
*Attorney, Agent, or Firm*—William W. Jones

[57] ABSTRACT

The flow of hydraulic fluid to and from an hydraulic elevator piston is controlled by a motor-actuated spool valve operated by a microprocessor. To lower the elevator, a main check valve is opened by a down piston using hydraulic fluid from the system. Pressure is equalized on both sides of the main check valve just before the latter is opened thereby allowing the use of a smaller down piston using less hydraulic fluid. This results in smoother car motion during descent of the car. The addition of a solenoid valve bleed passage to equalize pressure on both sides of the check valve also prevents rapid descent of the elevator car in the event that the spool valve were to be open at the time descent commences.

4 Claims, 1 Drawing Sheet

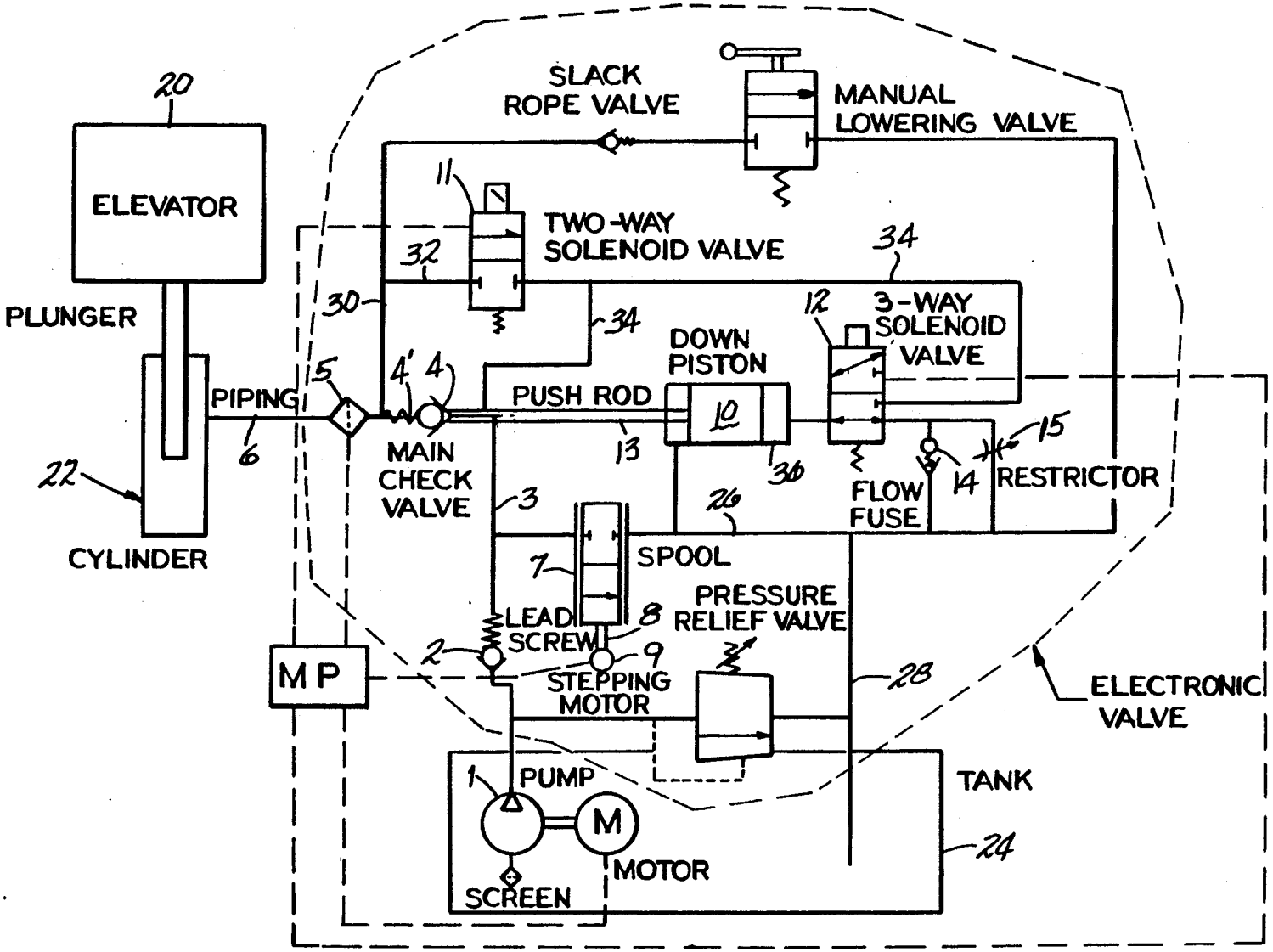
ELECTRONIC VALVE
RESTRICTOR
MANUAL LOWERING VALVE
3-WAY SOLENOID VALVE
FLOW FUSE
TANK
DOWN PISTON
PRESSURE RELIEF VALVE
SPOOL
SLACK ROPE VALVE
TWO-WAY SOLENOID VALVE
PUSH ROD
STEPPING MOTOR
LEAD SCREW
PUMP
MOTOR
SCREEN
MAIN CHECK VALVE
MP
PIPING
ELEVATOR
PLUNGER
CYLINDER

HYDRAULIC ELEVATOR CONTROL VALVE

DESCRIPTION

1. Technical Field

This invention relates to a system for supplying and withdrawing hydraulic fluid to and from an hydraulic elevator piston/cylinder assembly, and more particularly, to an improved system wherein downward movement of the elevator is smoother and safer.

2. Background Art

U.S. Pat. Nos. 4,700,748 granted Oct. 20, 1987; and 4,726,450 granted Feb. 23, 1988 both to Otis Elevator Company both describe an hydraulic elevator assembly which uses a motor driven spool valve controlled by a microprocessor to regulate hydraulic fluid flow to and from the piston/cylinder lifting mechanism in the elevator. The spool valve is adjusted, in response to elevator speed and position sensed by the microprocessor, to start, stop, accelerate and decelerate the elevator. Flow of the hydraulic fluid from the piston/cylinder to the storage tank passes through the spool valve. The spool valve is adjusted as conditions warrant to split fluid flow from the pump to the piston/cylinder and to the storage tank; or to limit fluid flow from the piston/cylinder to the storage tank. The same spool valve also controls flow from the piston/cylinder to the tank when the fluid is to be withdrawn from the piston/cylinder to lower the car. The use of one spool valve to control all of the modes of fluid flow in the system results in a relatively complicated spool. The use of the same spool to control pressure equalization and fluid flow could result in a perceptible downward movement of the elevator car as descent begins if the spool valve is opened too far.

DISCLOSURE OF THE INVENTION

This invention relates to an improved motor controlled hydraulic elevator fluid flow regulating system wherein pressure equalization is controlled by a solenoid valve which is separate and apart from the spool valve and ensures equalization of pressure on both sides of the main check valve just prior to opening the main check valve and beginning descent of the elevator car. The fact that pressure equalization is accomplished allows the use of a smaller down piston to open the main check valve to commence downward movement of the elevator. The smaller piston requires less hydraulic fluid to operate whereby perceptible car movement will not occur when the hydraulic fluid is supplied to the down piston for the check valve-opening operation. The use of the separate solenoid valve also ensures that the elevator car will not precipitously drop if the solenoid valve were to be opened with the spool valve being simultaneously open. In such a case, hydraulic fluid would merely flow at a controlled rate from the piston/cylinder through the solenoid valve, through the open spool valve to the storage tank. The main check valve will not open because: the pressure developed internally on the spool valve side of the main check valve will be low because of the open spool valve; there will be a large pressure differential acting across the main check valve holding it closed; the pilot pressure supplied to the down piston to provide the main check valve opening force will be low; and the area ratio of the down piston to the check valve is low. This provides an added measure of safety to the operation of the elevator. Longer main check valve seal life is also provided since opening against a pressure differential reduces seal life, and with the instant invention the pressure differential is eliminated before opening the main check valve.

It is therefore an object of this invention to provide an improved hydraulic elevator fluid flow regulating system.

It is a further object of this invention to provide a fluid flow regulating system of the character described wherein unduly accelerated downward movement of the elevator car is prevented.

It is an additional object of this invention to provide a fluid flow regulating system of the character described wherein a smaller down piston is employed.

It is another object of this invention to provide a fluid flow regulating system of the character described wherein downward movement of the elevator car is minimized when the main check valve is being opened to lower the car.

It is yet an additional object to provide a fluid flow regulating system of the character described which results in increased main check valve seal life.

BRIEF DESCRIPTION OF THE DRAWING

These and other objects and advantages of the invention will become more readily apparent from the following detailed description of a preferred embodiment thereof when taken in conjunction with the drawing which is a schematic view of a preferred embodiment of the invention.

BEST MODE FOR CARRYING OUT THE INVENTION

Referring to the drawing, the elevator car and piston/cylinder components are denoted generally by the numerals 20 and 22, respectively. Line 6 supplies hydraulic fluid to the piston/cylinder 22 from a pump 1 in a storage tank 24, and return. The pump 1 supplies hydraulic fluid through a check valve 2 to a spool valve 7 which is adjustable by means of a lead screw 8 operated by a motor 9. The motor 9 is a reversible electric stepping motor, and its operation is controlled by a microprocessor M.P. as set forth in the above-noted prior art.

The uprun of the elevator 20 is performed in the same manner as described in the aforesaid prior art, and therefore will only be briefly described herein. To begin the uprun, on signal from the microprocessor MP, the pump motor M is turned on and the spool valve 7 is opened to enable the pump 1 to pump hydraulic fluid from the tank 24 through the check valve 2 to the spool valve 7. Since the spool valve 7 is in its open condition, the hydraulic fluid merely flows through the valve 7, lines 26 and 28 back into the tank 24. The microprocessor MP then actuates the stepping motor 9 to cause the screw 8 to begin closure of the spool valve 7. The spool valve 7 is quickly closed until pressure in the line 3 increases to a point wherein the check valve 4 begins to open. Initial movement of the check valve 4 is sensed by sensor 5 which is connected to the microprocessor MP. Upon reception of a signal from the sensor 5, the microprocessor MP slows the closure rate of the spool valve 7 so flow to the piston/cylinder 22 is gradually increased to provide a smooth lifting motion to the car 20. The spool valve 7 is then closed sufficiently to provide the desired velocity to the car 20 during its uprun. The car 20 is then gradually stopped by gradually reopening the spool valve 7 until hydraulic pressure in the piston/-cylinder 22 exceeds that in the line 3 thus causing the check valve 4 to close.

When a downrun of the car 20 is to begin the pump 1 will be turned off, and the spool valve 7 will be closed. The solenoid valve 11 is opened to allow hydraulic fluid from the line 6 to pass through the lines 30 and 32, through the solenoid valve 11, and through line 34 to the pump side of the main check valve 4. Since the fluid pressure on both sides of the main check valve 4 is equal, the only force holding the valve 4 closed is derived from its spring 4'. The microprocessor MP also opens the solenoid valve 12 and hydraulic fluid flows from the solenoid valve 11 or from the fluid path 3 through line 34 and through the open solenoid valve 12 into the down piston chamber 36. The down piston 10 is mounted in the chamber or cylinder 36 and includes a piston rod 13 which is aligned with the main check valve 4, but does not normally contact the latter. When the chamber 36 is pressurized, the piston 10 and piston rod 13 move to the left as shown in the drawing, and the piston rod 13 pushes the valve 4 open. Since both sides of the valve 4 are at equal pressure once the solenoid 11 opens, only the force of the spring 4' need be overcome to open the valve 4. This allows the use of a smaller piston 10, and requires less of the hydraulic fluid in the chamber 36 to actuate the piston 10. Thus less fluid is bled from the piston/cylinder 22 resulting in minimal preliminary movement of the car 20 when the solenoid valves 11 and 12 are opened. When the valve 4 is opened, the sensor 5 signals the microprocessor MP to actuate the stepping motor 9 to begin to open the spool valve 7. The spool valve 7 is initially opened slowly to allow hydraulic fluid to flow past the open valve 4 through the line 3 and the spool valve 7, and through the lines 26 and 28 to the tank 24.

The force which can be exerted by the down piston 10 against the check valve 4 is not enough to open the latter against a substantial pressure differential because of the small area of the piston 10 and because the pressure supplied to the down piston 10 is the same as the pressure on the pump side of the check valve. This is a safety feature which prevents opening of the main check valve 4 when the spool valve 7 is open, which would result in a sudden fast start down of the car 20.

The degree to which the spool valve 7 is opened will determine the speed of descent of the elevator car 20. The main check valve 4 in its fully open position will only have a small pressure drop across it so that the piston 10 will be able to hold it open at normal flow rates. If the fluid flow rate (and associated elevator speed) is excessive across the check valve 4, the pressure differential will increase and the piston 10 will not be able to hold the check valve 4 open. This is a safety feature to prevent excessive overspeed. Car position sensors of conventional construction (not shown) located in the hoistway sense where the car 20 is and transmit that information to the microprocessor MP. The microprocessor MP uses that information to properly control the spool valve 7. When the called floor is reached, the spool valve 7 is closed, and the solenoid valves 11 and 12 are closed. The pressure differential across the valve 4 is thus increased, and the valve 4 closes pushing the piston 10 and rod 13 to the right as seen in the drawing. Fluid escapes from the chamber 36 through the valve 12 and the flow regulator 14, and passes through the line 28 to the tank 24.

In the event of a power failure or other emergency, the solenoid valves 11 and 12 would be de-energized and closed, and the elevator car 20 would be stopped by the closing of the main check valve 4. The rate at which the main check valve 4 closes is limited by the flow regulator 14. Limiting the rate of check valve closing in this manner achieves a smooth stopping of the elevator during emergency conditions.

It will be readily appreciated that when a small piston is used relative to the size of the main check valve, the main check valve cannot be opened or held open when there is a significant pressure drop across the main check valve. This results in additional safety features. If the spool valve is open when the solenoid valves are energized and opened, fluid will flow through the solenoid valves and out to the tank through the open spool valve without building up significant pressure on the spool side of the main check valve, or at the down piston, thus the main check valve will not open. The elevator will descend at the rate controlled by oil flow through the first solenoid valve which will be slow. If a large down piston were used without this added fluid connection around the main check valve, the elevator would almost immediately begin descending at high speed if the solenoid valves were energized with the spool valve open —an unsafe condition.

Since many changes and variations of the disclosed embodiment of the invention may be made without departing from the inventive concept, it is not intended to limit the invention otherwise than as required by the appended claims.

What is claimed is:

1. An hydraulic elevator system comprising:

(a) an elevator car;

(b) a piston/cylinder assembly for raising and lowering said elevator car;

(c) a supply of hydraulic fluid and a fluid pump for delivering hydraulic fluid to said piston/cylinder assembly;

(d) an adjustable metering valve for controlling hydraulic fluid flow to and from said piston/cylinder assembly;

(e) biased check valve means interposed between said piston/cylinder assembly and said metering valve said check valve means normally being closed by a positive fluid pressure differential on the piston/-cylinder side thereof;

(f) fluid actuated means operable with fluid from said piston/cylinder assembly to selectively open said check valve means to allow withdrawal of hydraulic fluid from said piston/cylinder assembly during a downrun of said elevator car;

(g) bypass valve means interconnecting said piston/-cylinder and said metering valve sides of said check valve means around said check valve means; and (h) means for selectively opening said bypass valve means prior to commencement of a downrun of said elevator car to equalize fluid pressure on both sides of said check valve means whereby the latter remains closed solely by reason of its being biased.

2. The elevator system of claim 1 further comprising means for connecting said bypass valve means with said fluid actuated means for delivering hydraulic fluid to said fluid actuated means after equalization of pressure on both sides of said check valve means to enable said fluid actuated means to then open said check valve means.

3. The hydraulic elevator system of claim 1 further including means for preventing actuation of said fluid actuated means when said metering valve is at a partial or full open setting.

4. An hydraulic valve assembly for controlling flow of hydraulic fluid from an hydraulic elevator piston/-cylinder assembly to a hydraulic fluid storage tank during a downrun of the elevator, said valve assembly comprising:

(a) an adjustable metering valve for controlling hydraulic fluid flow to and from the piston/cylinder assembly;

(b) a normally closed biased check valve interposed between said metering valve and the piston/cylinder assembly;

(c) fluid actuated means for selectively opening said check valve;

(d) a bypass valve interconnecting the piston/cylinder side of said check valve and the metering valve side of said check valve, said bypass valve, when open, being operable to equalize fluid pressure on both sides of said check valve; and (e) means connecting said bypass valve and said fluid actuated means for delivering actuating fluid to the latter when said bypass valve is open.

* * * * *